US009388024B1

(12) United States Patent
McCully

(10) Patent No.: US 9,388,024 B1
(45) Date of Patent: Jul. 12, 2016

(54) VEHICLE HOIST DEVICE

(71) Applicant: Michael E. McCully, Tahlequah, OK (US)

(72) Inventor: Michael E. McCully, Tahlequah, OK (US)

( * ) Notice: Subject to any disclaimer, the term of this patent is extended or adjusted under 35 U.S.C. 154(b) by 173 days.

(21) Appl. No.: 14/161,186

(22) Filed: Jan. 22, 2014

(51) Int. Cl.
*B66C 23/46* (2006.01)

(52) U.S. Cl.
CPC ..... *B66C 23/46* (2013.01)

(58) Field of Classification Search
USPC ..... 254/325
See application file for complete search history.

(56) References Cited

U.S. PATENT DOCUMENTS

| | | | | | |
|---|---|---|---|---|---|
| 2,078,393 | A | | 4/1937 | Le Torneau | |
| 3,804,207 | A | * | 4/1974 | Stonebraker | B66F 11/04 182/103 |
| 4,806,063 | A | * | 2/1989 | York | A22B 5/06 212/180 |
| 5,540,537 | A | * | 7/1996 | Welch | B60P 1/5471 212/180 |
| 5,662,451 | A | * | 9/1997 | Muzzi | B60P 1/5471 212/180 |
| 5,788,095 | A | * | 8/1998 | Watson | B66C 23/44 212/180 |
| 5,971,177 | A | * | 10/1999 | Carter | B66C 23/44 212/177 |
| 5,992,759 | A | * | 11/1999 | Patterson | A01C 23/00 239/159 |
| D429,051 | S | | 8/2000 | Porter | |
| 6,202,868 | B1 | * | 3/2001 | Murray | A22B 5/06 212/227 |
| 6,250,483 | B1 | * | 6/2001 | Frommer | A22B 5/06 212/180 |
| 6,599,078 | B1 | * | 7/2003 | Elder | B60P 1/5471 212/180 |
| 6,616,397 | B1 | * | 9/2003 | Lester | B66C 23/44 212/177 |
| 6,763,635 | B1 | * | 7/2004 | Lowman | B60P 1/5433 378/198 |
| D597,724 | S | | 8/2009 | Rumreich | |
| 7,575,120 | B2 | * | 8/2009 | Beatty | B66C 23/44 212/180 |
| 7,770,870 | B1 | * | 8/2010 | Fly | B60D 1/065 224/512 |
| 7,845,622 | B1 | * | 12/2010 | Riggs | B66C 23/44 212/180 |
| 8,047,331 | B2 | * | 11/2011 | Spicer | E06C 5/02 182/127 |
| 8,851,823 | B1 | * | 10/2014 | Hallmon, Jr. | B66C 23/44 414/540 |
| 2004/0234367 | A1 | * | 11/2004 | Pacini | B60R 9/06 414/543 |
| 2006/0045704 | A1 | * | 3/2006 | Laufenberg | B60P 1/548 414/543 |
| 2010/0200822 | A1 | * | 8/2010 | Kitchens, Sr. | B66C 23/44 254/326 |

* cited by examiner

*Primary Examiner* — Emmanuel M Marcelo
*Assistant Examiner* — Nathaniel Adams

(57) ABSTRACT

A vehicle hoist device couples a hoist to a vehicle hitch for lifting heavy objects. The device includes a hitch mount and a cavity extending into a bottom end of the hitch mount wherein the bottom end of the hitch mount is configured for being seated on a ball hitch extending from a vehicle. A bottom end of a boom arm is coupled to the hitch mount. A pulley is coupled to the boom arm and positioned proximate the top end of the boom arm. A hoist is coupled to the boom arm proximate the bottom end of the boom arm. A line is coupled to the hoist such that the line is selectively extendable and retractable from the hoist. The line extends through the pulley.

12 Claims, 7 Drawing Sheets

VEHICLE HOIST DEVICE

BACKGROUND OF THE DISCLOSURE

Field of the Disclosure

The disclosure relates to hoist devices and more particularly pertains to a new hoist device for coupling a hoist to a vehicle hitch for lifting heavy objects.

SUMMARY OF THE DISCLOSURE

An embodiment of the disclosure meets the needs presented above by generally comprising a hitch mount and a cavity extending into a bottom end of the hitch mount wherein the bottom end of the hitch mount is configured for being seated on a ball hitch extending from a vehicle. A bottom end of a boom arm is coupled to the hitch mount. A pulley is coupled to the boom arm and positioned proximate the top end of the boom arm. A hoist is coupled to the boom arm proximate the bottom end of the boom arm. A line is coupled to the hoist such that the line is selectively extendable and retractable from the hoist. The line extends through the pulley.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
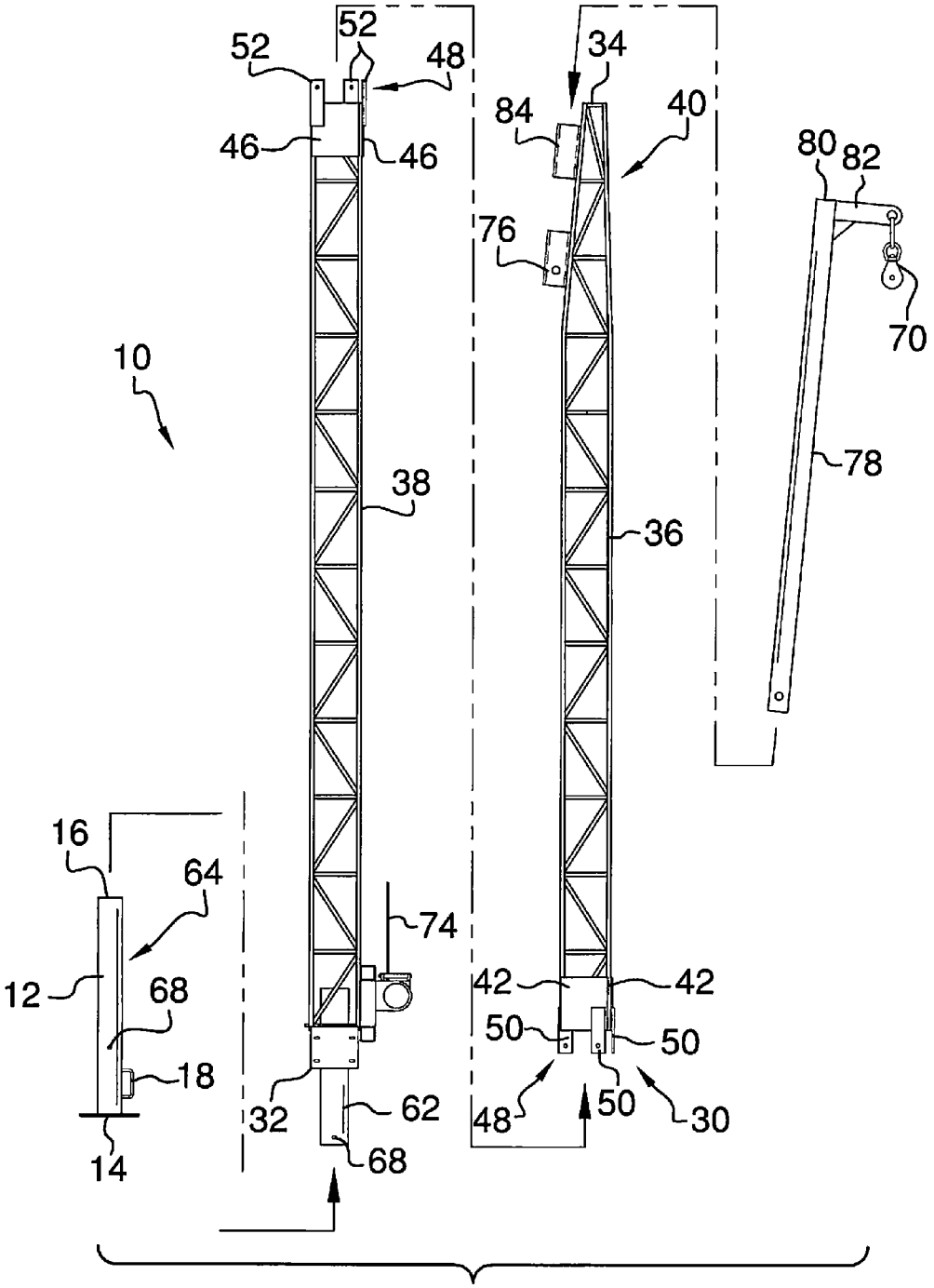
FIG. 1 is a partially exploded side view of a vehicle hoist device according to an embodiment of the disclosure.
Figure 2:
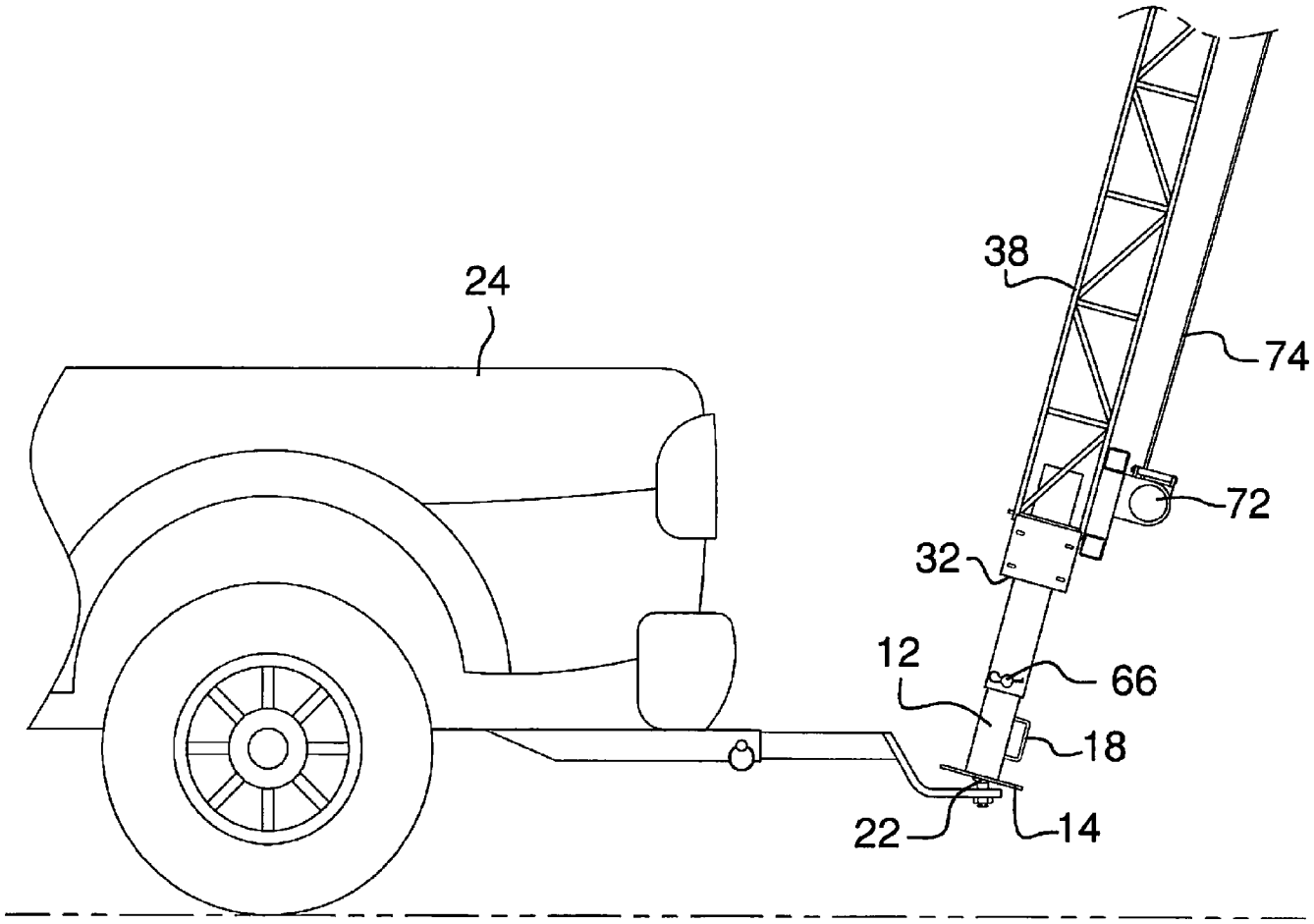
FIG. 2 is a side view of a bottom portion of an embodiment of the disclosure.
Figure 3:
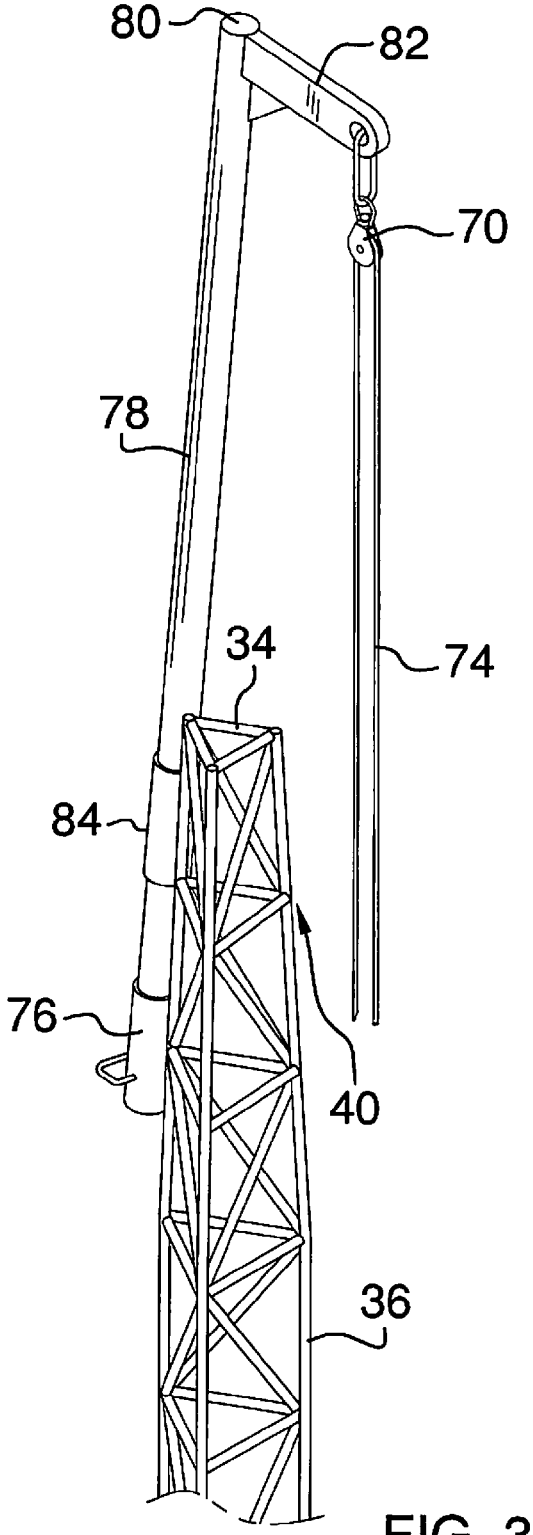
FIG. 3 is a side view of a top portion of an embodiment of the disclosure.
Figure 4:
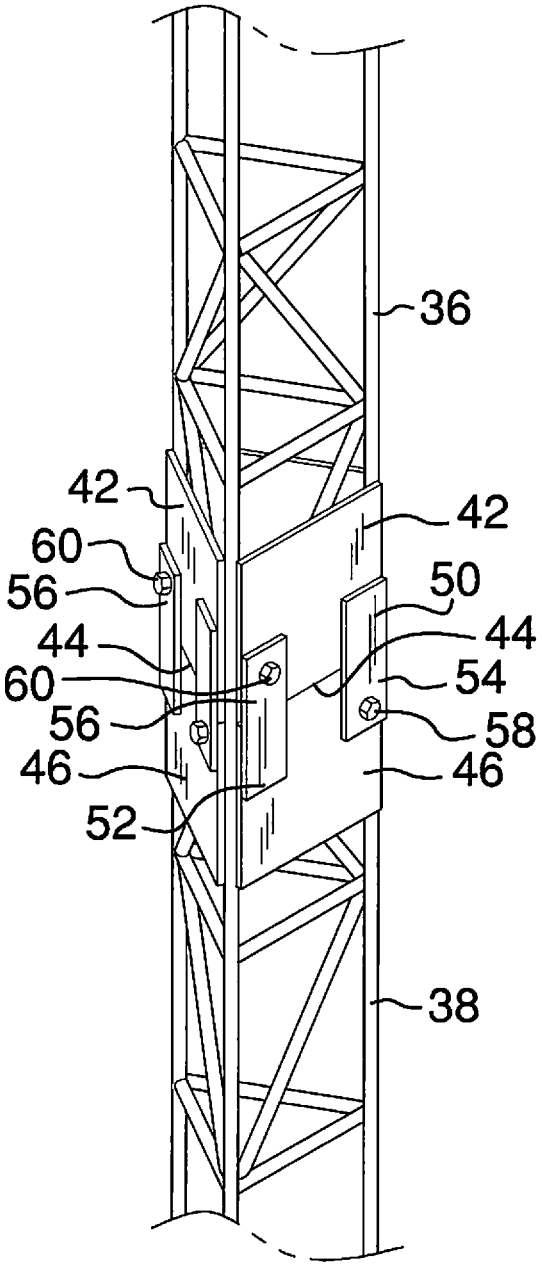
FIG. 4 is a side view of a middle portion of an embodiment of the disclosure.
Figure 5:
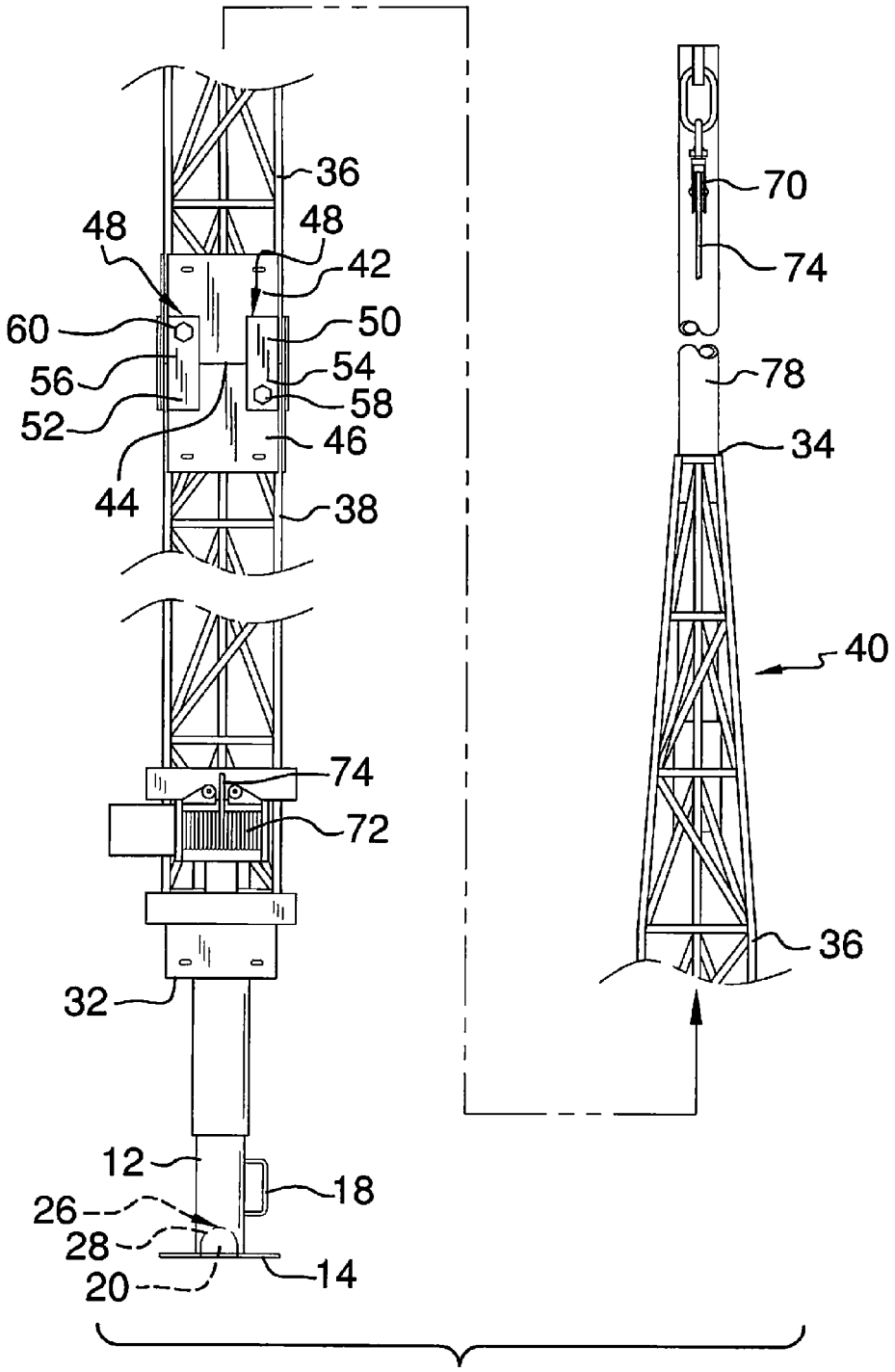
FIG. 5 is a front view of an embodiment of the disclosure.
Figure 6:
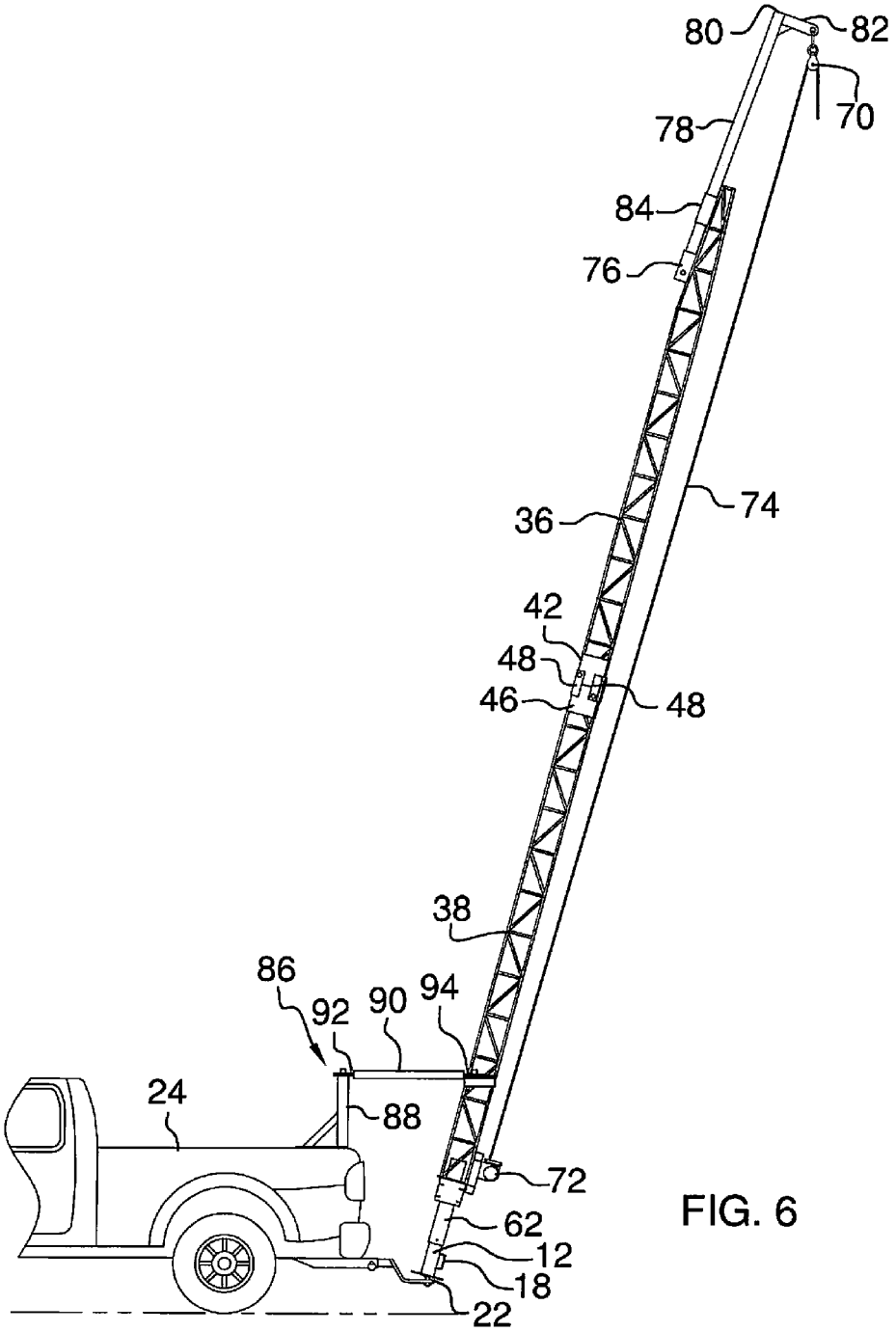
FIG. 6 is a side view of an embodiment of the disclosure in use.
Figure 7:
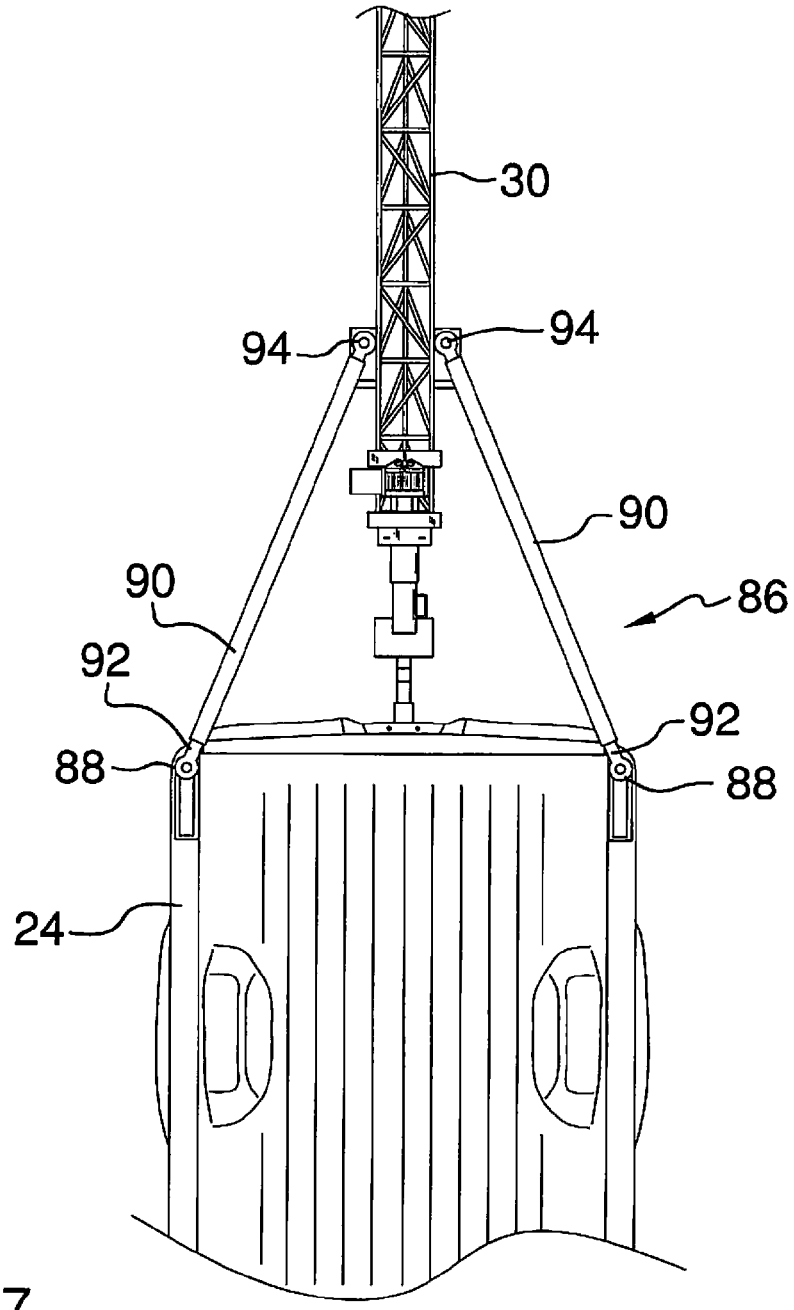
FIG. 7 is a top view of an embodiment of the disclosure.

With reference now to the drawings, and in particular to FIGS. 1 through 7 thereof, a new hoist device embodying the principles and concepts of an embodiment of the disclosure and generally designated by the reference numeral 10 will be described.

As best illustrated in FIGS. 1 through 7, the vehicle hoist device 10 generally comprises a hitch mount 12 having a bottom end 14 and a top end 16. The bottom end 14 of the hitch mount 12 is planar and transverse relative to a longitudinal axis of the hitch mount 12 allowing the hitch mount 12 to be set upon a level support surface. A handle 18 is coupled to and extends from the hitch mount 12 to facilitate manipulation of the hitch mount 12. A cavity 20 extends into the bottom end 14 of the hitch mount 12 wherein the bottom end 14 of the hitch mount 12 is configured for being seated on a ball hitch 22 extending from a vehicle 24. A top 26 of a wall 28 defining the cavity 20 is hemi-spherical.

A boom arm 30 has a bottom end 32 and a top end 34. The bottom end 32 of the boom arm 30 is coupled to the hitch mount 12 as further described below. The boom arm 30 has a top section 36 and a bottom section 38. The top section 36 is removably coupled to the bottom section 38. A top portion 40 of the boom arm 30 tapers extending towards the top end 36 of the boom arm 30. Each of a plurality of upper plates 42 is coupled to the top section 36 of the boom arm 30 adjacent to a junction 44 of the top section 36 of the boom arm 30 and the bottom section 38 of the boom arm 30. Each of a plurality of lower plates 46 is coupled to the bottom section 38 of the boom arm 30 adjacent to the junction 44 of the top section 36 of the boom arm 30 and the bottom section 38 of the boom arm 30. The boom arm 30 may have a triangular transverse cross-sectional shape wherein there are three upper plates 42 and three lower plates 46.

A plurality of connectors 48 couples each upper plate 42 to an associated one of the lower plates 46 wherein the bottom section 38 of the boom arm 30 is coupled to the upper section 36 of the boom arm 30. The connectors 48 comprise a plurality of upper connectors 50 and a plurality of lower connectors 52. Each upper connector 50 is fixedly coupled to and extends from an associated one of the upper plates 42 such that a distal portion 54 of the upper connector 50 relative to the upper plate 42 extends over an associated one of the lower plates 46. Each lower connector 52 is fixedly coupled to and extends from an associated one of the lower plates 46 such that a distal portion 56 of the lower connector 52 relative to the lower plate 46 extends over an associated one of the upper plates 42. Each of a plurality of fasteners 58 removably couples the distal section 54 of an associated one of the upper connectors 50 to the associated lower plate 46. Similarly, each of a plurality of couplers 60 removably couples the distal section 56 of an associated one of the lower connectors 52 to the associated upper plate 42.

A socket 62 is coupled to and extends from the bottom end 32 of the boom arm 30. The socket 62 receives a top portion 64 of the hitch mount 12 wherein the boom arm 30 is coupled to and extends from the hitch mount 12. A locking pin 66 is insertable through aligned apertures 68 in the socket 62 and the hitch mount 12 when the hitch mount 12 is fully received in the socket 62 to secure the boom arm 30 to the hitch mount 12.

A pulley 70 is coupled to the boom arm 30. The pulley 70 is positioned proximate the top end 34 of the boom arm 30. A hoist 72 is coupled to the boom arm 30. The hoist 72 is coupled to the boom arm 30 proximate the bottom end 32 of the boom arm 30. The hoist 72 may be of conventional construction and may be motorized. A line 74 is coupled to the hoist 72 such that the line 74 is selectively extendable and retractable from the hoist 72. The line 74 extends through the pulley 70.

A first sleeve 76 is coupled to the boom arm 30. The first sleeve 76 is coupled to the top portion 40 of the boom arm 30. A pole 78 is positionable in the first sleeve 76 such that the pole 78 extends upwardly from the boom arm 30. The pulley 70 is coupled to a distal end 80 of the pole 78 relative to the boom arm 30. The pole 78 positions the pulley 70 laterally offset from the boom arm 30. An offset extension 82 may extend from the top portion 40 of the boom arm 30 to enhance the offset of the pulley 70. A second sleeve 84 may be aligned with and positioned in spaced relationship to the first sleeve 76. The second sleeve 84 is positioned between the first sleeve 76 and the top end 34 of the boom arm 30. The pole 78 extends fully through the second sleeve 84 when the pole 78 is coupled to the boom arm 30.

A support structure 86 may be provided to stabilize the boom arm 30. The support structure 86 may include a pair of vertical stands 88 and a pair of arms 90. Each of the arms 90 has a respective first end 92 configured for coupling to the vehicle 24 by attachment to one of the vertical stands 88. Each of the arms 90 has a respective second end 94 coupled to the boom arm 30 such that the boom arm 30 is held in a static position relative to the vehicle 24.

In use, the device 10 is assembled to extend from the vehicle 24. The line 74 is selectively extended and retracted from the hoist 72 to lift items as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vehicle hoist device comprising:

a hitch mount, said hitch mount having a bottom end and a top end;

a cavity extending into said bottom end of said hitch mount wherein said bottom end of said hitch mount is configured for being seated on a ball hitch extending from a vehicle, a top of a wall defining said cavity being hemispherical;

a boom arm having a bottom end and a top end, said bottom end of said boom arm being coupled to said hitch mount, said boom arm having a top section and a bottom section, said top section being removably coupled to said bottom section;

a pulley coupled to said boom arm, said pulley being positioned proximate said top end of said boom arm;

a hoist coupled to said boom arm, said hoist being coupled to said boom arm proximate said bottom end of said boom arm;

a line coupled to said hoist such that said line is selectively extendable and retractable from said hoist, said line extending through said pulley;

a plurality of upper plates, each of said upper plates being coupled to said top section of said boom arm adjacent to a junction of said top section of said boom arm and said bottom section of said boom arm;

a plurality of lower plates, each of said lower plates being coupled to said bottom section of said boom arm adjacent to said junction of said top section of said boom arm and said bottom section of said boom arm;

a plurality of connectors coupling each said upper plate to an associated one of said lower plates wherein said bottom section of said boom arm is coupled to said upper section of said boom arm; and a pair of arms, each of said arms having a respective first end configured for coupling to the vehicle, each of said arms having a respective second end coupled to said boom arm such that said boom arm is held in a static position relative to the vehicle.

2. The device of claim 1, further comprising a socket coupled to and extending from said bottom end of said boom arm, said socket receiving a top portion of said hitch mount wherein said boom arm is coupled to and extends from said hitch mount.

3. The device of claim 2, further comprising a locking pin insertable through aligned apertures in said socket and said hitch mount when said hitch mount is fully received in said socket.

4. The device of claim 1, further comprising a handle coupled to and extending from said hitch mount.

5. The device of claim 1, further comprising:

said connectors comprising a plurality of upper connectors, each said upper connector being fixedly coupled to and extending from an associated one of said upper plates such that a distal portion of said upper connector relative to said upper plate extends over an associated one of said lower plates; and a plurality of fasteners, each said fastener removably coupling said distal portion of an associated one of said upper connectors to said associated lower plate.

6. The device of claim 1, further comprising:

said connectors comprising a plurality of lower connectors, each said lower connector being fixedly coupled to and extending from an associated one of said lower plates such that a distal portion of said lower connector relative to said lower plate extends over an associated one of said upper plates; and a plurality of couplers, each said coupler removably coupling said distal portion of an associated one of said lower connectors to said associated upper plate.

7. The device of claim 1, further comprising:

a sleeve coupled to said boom arm; and a pole, said pole being positionable in said sleeve such that said pole extends upwardly from said boom arm, said pulley being coupled to a distal end of said pole relative to said boom arm.

8. The device of claim 7, further comprising a top portion of said boom arm tapering extending towards said top end of said boom arm.

9. The device of claim 8, further comprising said sleeve being a first sleeve, said first sleeve being coupled to said top portion of said boom arm.

10. The device of claim 9, further comprising a second sleeve, said second sleeve being aligned with and positioned in spaced relationship to said first sleeve, said second sleeve being positioned between said first sleeve and said top end of said boom arm, said pole extending fully through said second sleeve when said pole is coupled to said boom arm.

11. The device of claim 1, further comprising said bottom end of said hitch mount being planar and transverse relative to a longitudinal axis of said hitch mount.

12. A vehicle hoist device comprising:

a hitch mount, said hitch mount having a bottom end and a top end, said bottom end of said hitch mount being planar and transverse relative to a longitudinal axis of said hitch mount;

a handle coupled to and extending from said hitch mount;

a cavity extending into said bottom end of said hitch mount wherein said bottom end of said hitch mount is configured for being seated on a ball hitch extending from a vehicle, a top of a wall defining said cavity being hemispherical;

a boom arm having a bottom end and a top end, said bottom end of said boom arm being coupled to said hitch mount, said boom arm having a top section and a bottom section, said top section being removably coupled to said bottom section, a top portion of said boom arm tapering extending towards said top end of said boom arm;

a plurality of upper plates, each of said upper plates being coupled to said top section of said boom arm adjacent to a junction of said top section of said boom arm and said bottom section of said boom arm;

a plurality of lower plates, each of said lower plates being coupled to said bottom section of said boom arm adjacent to said junction of said top section of said boom arm and said bottom section of said boom arm;

a plurality of connectors coupling each said upper plate to an associated one of said lower plates wherein said bottom section of said boom arm is coupled to said upper section of said boom arm, said connectors comprising a plurality of upper connectors, each said upper connector being fixedly coupled to and extending from an associated one of said upper plates such that a distal portion of said upper connector relative to said upper plate extends over an associated one of said lower plates, said connectors comprising a plurality of lower connectors, each said lower connector being fixedly coupled to and extending from an associated one of said lower plates such that a distal portion of said lower connector relative to said lower plate extends over an associated one of said upper plates;

a plurality of fasteners, each said fastener removably coupling said distal portion of an associated one of said upper connectors to said associated lower plate;

a plurality of couplers, each said coupler removably coupling said distal portion of an associated one of said lower connectors to said associated upper plate;

a pulley coupled to said boom arm, said pulley being positioned proximate said top end of said boom arm;

a hoist coupled to said boom arm, said hoist being coupled to said boom arm proximate said bottom end of said boom arm;

a line coupled to said hoist such that said line is selectively extendable and retractable from said hoist, said line extending through said pulley;

a socket coupled to and extending from said bottom end of said boom arm, said socket receiving a top portion of said hitch mount wherein said boom arm is coupled to and extends from said hitch mount;

a locking pin insertable through aligned apertures in said socket and said hitch mount when said hitch mount is fully received in said socket;

a first sleeve coupled to said boom arm, said first sleeve being coupled to said top portion of said boom arm;

a pole, said pole being positionable in said sleeve such that said pole extends upwardly from said boom arm, said pulley being coupled to a distal end of said pole relative to said boom arm;

a second sleeve, said second sleeve being aligned with and positioned in spaced relationship to said first sleeve, said second sleeve being positioned between said first sleeve and said top end of said boom arm, said pole extending fully through said second sleeve when said pole is coupled to said boom arm; and a pair of arms, each of said arms having a respective first end configured for coupling to the vehicle, each of said arms having a respective second end coupled to said boom arm such that said boom arm is held in a static position relative to the vehicle.

* * * * *